US008693937B2

(12) United States Patent
Futamata et al.

(10) Patent No.: US 8,693,937 B2
(45) Date of Patent: Apr. 8, 2014

(54) FIXING DEVICE PROVIDED WITH PRESSURE BELT

(75) Inventors: Yukio Futamata, Shizuoka (JP); Hiroshi Katakura, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 109 days.

(21) Appl. No.: 13/491,967

(22) Filed: Jun. 8, 2012

(65) Prior Publication Data

US 2012/0321360 A1 Dec. 20, 2012

Related U.S. Application Data

(60) Provisional application No. 61/496,692, filed on Jun. 14, 2011.

(51) Int. Cl.
*G03G 15/20* (2006.01)

(52) U.S. Cl.
USPC ..... 399/329

(58) Field of Classification Search
CPC ..... G03G 2215/2209; G03G 15/20
USPC ..... 399/329
See application file for complete search history.

(56) References Cited

U.S. PATENT DOCUMENTS

| | | | | |
|---|---|---|---|---|
| 4,242,566 | A * | 12/1980 | Scribner | 399/329 |
| 7,522,870 | B2 * | 4/2009 | Fujino | 399/329 |
| 2006/0198670 | A1 * | 9/2006 | Baba et al. | 399/329 |
| 2006/0245798 | A1 * | 11/2006 | Nakayama | 399/329 |
| 2010/0189477 | A1 | 7/2010 | Yamada | |
| 2010/0254736 | A1 * | 10/2010 | Pirwitz | 399/329 |
| 2010/0322667 | A1 * | 12/2010 | Kitagawa | 399/329 |
| 2011/0085833 | A1 * | 4/2011 | Matsumoto | 399/329 |

FOREIGN PATENT DOCUMENTS

| | | |
|---|---|---|
| JP | 2003-122159 | 4/2003 |
| JP | 2008-241843 | 10/2008 |

* cited by examiner

*Primary Examiner* — Susan Lee
(74) *Attorney, Agent, or Firm* — Amin, Turocy & Watson, LLP

(57) ABSTRACT

A fixing device includes a fixing roller including a heat generating part, an endless belt facing the fixing roller, a first supporter which supports the belt to cause the belt to face the fixing roller at a first position, a second supporter which supports the belt at a downstream side in the rotation direction of the belt to cause the belt to face the fixing roller at a second position, and a pressure applying member having a center position, configured to urge the belt toward the fixing roller to form a nip between the fixing roller and the belt, wherein a first distance between the center position and the first position is longer than a second distance between the center position and the second position.

16 Claims, 5 Drawing Sheets

FIXING DEVICE PROVIDED WITH PRESSURE BELT

CROSS-REFERENCE TO RELATED APPLICATION

This application is based upon and claims the benefit of priority from Provisional U.S. Application 61/496692 filed on Jun. 14, 2011 the entire contents of which are incorporated herein by reference.

FIELD

Embodiments described herein relate generally to a fixing device used in an image forming apparatus.

BACKGROUND

In an image forming apparatus such as a copying machine or a printer, there is a fixing device in which, for the purpose of improving an environmental property, a belt member is used to widen a nip width between a heating member and a pressure member in order to start the apparatus at a high speed and to perform fixing at a low temperature. In the fixing device in which the belt member is used to widen the nip width, there is a fear that toner is shifted on a sheet during fixing by the deflection, floating or the like of the belt member, and an image is blurred.

DETAILED DESCRIPTION

In general, according to one embodiment, a fixing device includes a fixing roller including a heat generating part, an endless belt facing the fixing roller, a first supporter which supports the belt to cause the belt to face the fixing roller at a first position, a second supporter which supports the belt at a downstream side in the rotation direction of the belt to cause the belt to face the fixing roller at a second position, and a pressure applying member having a center position, configured to urge the belt toward the fixing roller to form a nip between the fixing roller and the belt, wherein a first distance between the center position and the first position is longer than a second distance between the center position and the second position.

Figure 1:
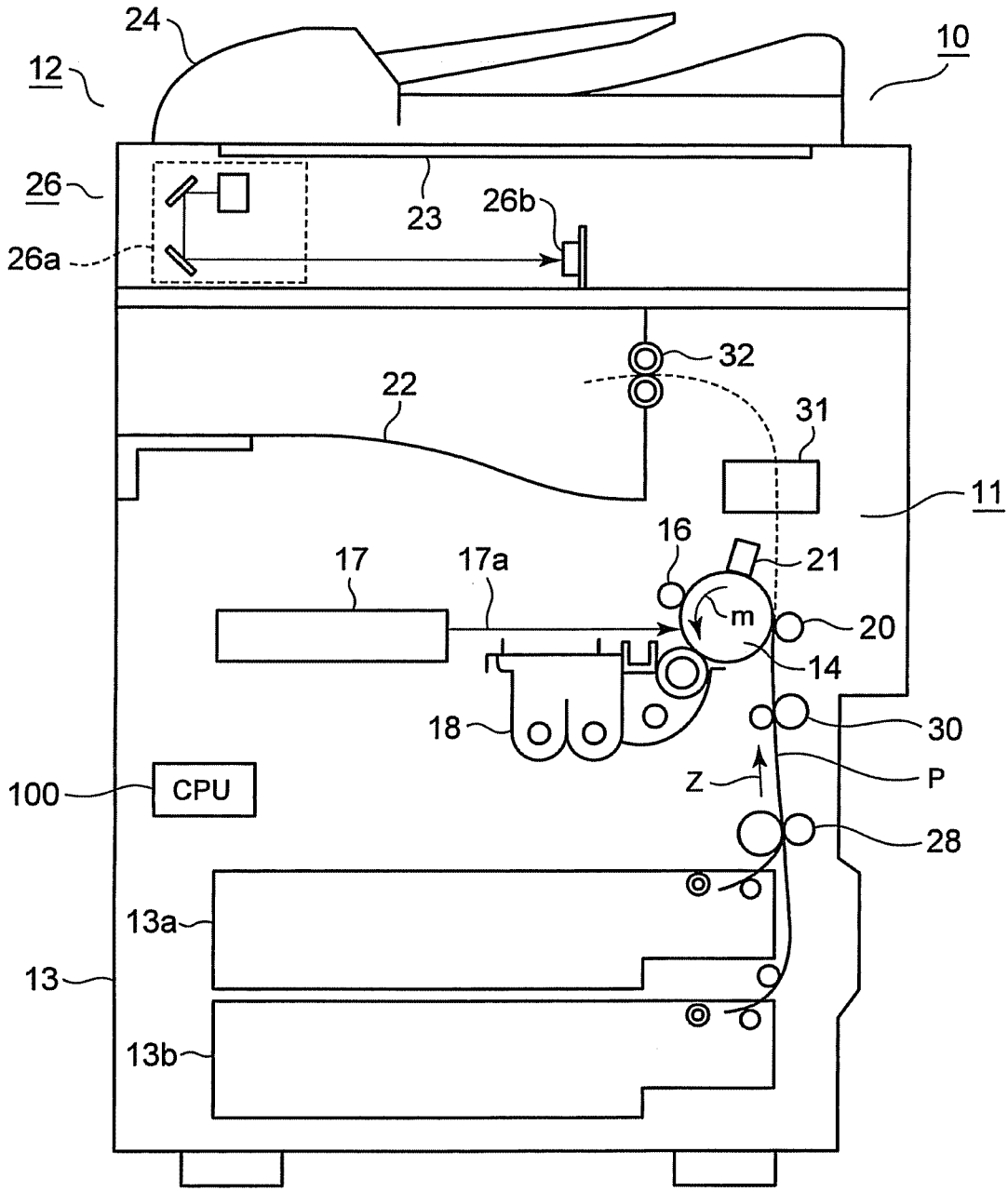
FIG. 1 is a schematic structural view showing an MFP including a fixing device of an embodiment.

Hereinafter, embodiments will be described. FIG. 1 is a schematic structural view showing an MFP (Multi Function Peripheral) 10 as an example of an image forming apparatus including a fixing device 31 of an embodiment. The MFP 10 includes a printer part 11 as an image forming part, a scanner part 12, a paper feed part 13 and a paper discharge part 22. The MFP 10 includes a CPU 100 to control the printer part 11, the scanner part 12, the paper feed part 13 and the paper discharge part 22.

The paper feed part 13 includes a first and a second paper feed cassette 13*a* and 13*b*. The paper feed cassettes 13*a* and 13*b* can feed both an unused sheet and a reuse sheet (a sheet obtained by erasing an image by a color erasing process).

The printer part 11 includes a charging device 16 to uniformly charge a photoconductive drum 14 rotating in an arrow m direction, and a laser exposing device 17 to form an electrostatic latent image on the photoconductive drum 14 by irradiating the charged photoconductive drum 14 with a laser beam 17*a* based on image data from the scanner part 12. The printer part 11 includes a developing device 18 to supply toner to the electrostatic latent image on the photoconductive drum 14, a transfer device 20 to transfer a toner image formed on the photoconductive drum 14 to a sheet P as a recording medium, and a cleaner 21.

The developing device 18 uses a two-component developer as a mixture of toner and magnetic carrier and supplies the toner to the electrostatic latent image on the photoconductive drum 14. The toner is, for example, a color erasable colorant and is a color erasable toner whose color can be erased by heating at a specific temperature. The color erasable toner contains a binder resin, a coloring compound as a colorant and a developer. If the toner image formed using the color erasable toner is heated at the specific temperature, the coloring compound and the developer in the toner are dissociated, and the color of the toner image is erased. For example, the color erasable toner is fixed to a sheet at a relatively low temperature of about 80 to 100° C., and the color is erased at a relatively high temperature of 180 to 200° C. The developing device 18 may use a color un-erasable toner whose color is not erased even if the toner is heated to the specific temperature.

The photoconductive drum 14, the charging device 16, the laser exposure device 17, the developing device 18, the transfer device 20 and the cleaner 21 constitute the image forming part. The printer part 11 includes the fixing device 31 between the photoconductive drum 14 and the paper discharge part 22.

The scanner part 12 includes an optical mechanism 26*a* to optically read a document on a document table 23, and a charge coupled device 26*b* to convert a light signal from the optical mechanism 26*a* into an electric signal.

The MFP 10 includes, between the paper feed part 13 and the photoconductive drum 14, a conveyance mechanism 28, a register roller pair 30 to convey the sheet P to between the photoconductive drum 14 and the transfer roller 20 in synchronization with the toner image on the photoconductive drum 14. The MFP 10 includes a paper discharging roller 32 to discharge the sheet P to the paper discharge part 22 after fixing.

By the structure as stated above, the MFP 10 transfers the color erasable toner image formed by the printer part 11 to the sheet P fed from the paper feed part 13. The MFP 10 fixes the sheet P having the color erasable toner image by the fixing device 31, and discharges the sheet to the paper discharge part 22 after completion of printing. The image forming apparatus is not limited to this. The image forming apparatus may include plural printer parts, that is, a printer part using a color erasable toner and a printer part using a color un-erasable toner. The print system of the printer part is not limited to the electrophotographic system, and may be an inkjet system or the like.

Figure 2:
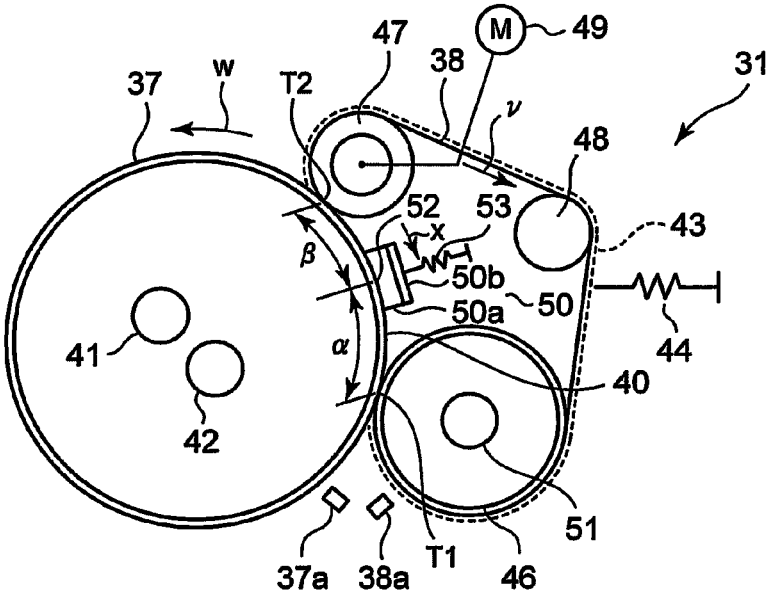
FIG. 2 is a schematic structural view showing the fixing device of the embodiment.

The fixing device 31 will be described in detail. As shown in FIG. 2, the fixing device 31 includes a heat roller 37 as a fixing roller that contacts the sheet P having a toner image, and a press belt 38 as a belt. The fixing device 31 nips and conveys the sheet P by a nip 40 formed between the heat roller 37 and the press belt 38, and heats, presses and fixes the toner image to the sheet P.

The heat roller 37 is such that a mold release layer is coated on a hollow aluminum roller. The heat roller 37 includes a first halogen lamp 41 and a second halogen lamp 42 which are a heat generating part and have the same heat generation amount in the hollow inside of the heat roller 37. For example, the luminous intensity distribution area of the first halogen lamp 41 is a center area in an axial direction of the heat roller 37, and the luminous intensity distribution area of the second halogen lamp 42 is side areas on both sides of the center area. The first halogen lamp 41 and the second halogen lamp 42 heat the whole area of the heat roller 37 in the axial direction.

The press belt 38 is stretched by a belt heat roller 46, an exit roller 47 and a tension roller 48, and rotates in an arrow v direction. A housing 43 to support the press belt 38 presses the press belt 38 to the heat roller 37 by a belt press mechanism 44. A nip pad 50 as a pressure applying member to press the press belt 38 to the heat roller 37 side exists between the belt heat roller 46 inside the press belt 38 and the exit roller 47.

The belt heat roller 46 as a first support part and as a first roller is such that a mold release layer is coated on a surface of a hollow aluminum roller. The belt heat roller 46 includes a third halogen lamp 51 as a second heat generating part in the hollow inside of the belt heat roller 46. In the third halogen lamp 51, the whole area of the belt heat roller 46 in the axial direction is a luminous intensity distribution area, and the whole area of the belt heat roller 46 is heated. The belt heat roller 46 is close to the heat roller 37. The press belt 38 contacts the heat roller 37 at a first position T1.

The exit roller 47 as a second support part and as a second roller includes a solid rubber around a core metal made of Steel Use Stainless (SUS). The exit roller 47 causes the press belt 38 to face and contact the heat roller 37 at a second position T2. As compared with the belt heat roller 46, the diameter of the exit roller 47 is small, and assists peeling of the sheet P from the heat roller 37 after the sheet passes through the nip 40. The tension roller 48 includes a PFA tube covered on the periphery of a core metal made of SUS. The fixing device 31 has a large nip width from the first position T1 to the second position T2.

For example, the exit roller 47 is connected to a motor 49 as a belt driving part. At the time of fixing, the press belt 38 is rotated in the arrow v direction by driving of the motor 49 through the exit roller 47. The exit roller 47 is driven to rotate the press belt 38, so that the deflection of the press belt 38 in the nip 40 is suppressed. The press belt 38 may be rotated by driving the belt heat roller 46 by the motor.

The heat roller 37 which comes in press contact with the press belt 38 is driven by the press belt 38 and is rotated in an arrow w direction. In the fixing device 31, the heat roller 37 may be driven instead of driving the press belt 38. The press belt 38 which comes in press contact with the heat roller 37 may be dependently driven by providing a motor as a fixing driving part to drive the heat roller 37.

The fixing device 31 includes a roller thermistor 37*a* to detect the temperature of the heat roller 37 and a belt thermistor 38*a* to detect the temperature of the press belt 38. The CPU 100 controls the temperature of the heat roller 37 or the press belt 38 according to the temperature detection result obtained by the roller thermistor 37*a* or the belt thermistor 38*a*.

The nip pad 50 is such that a silicone rubber 50*a* is bonded to an auxiliary plate 50*b*. For example, a slide sheet having a high sliding property and high wear resistance may be made to intervene between the nip pad 50 and the press belt 38. The slide sheet is made to intervene to reduce the friction between the nip pad 50 and the press belt 38.

The nip pad 50 is symmetrical with respect to a center position 52 as a center in the rotation direction of the press belt 38. In the rotation direction of the press belt 38, the first position T1 is located at the upstream side of the nip pad 50, and the second position T2 is located at the downstream side of the nip pad 50. If a first distance between the center position 52 and the first position T1 is $\alpha$, and a second distance between the center position 52 and the second position T2 is $\beta$, the nip pad 50 is located at a position where $\alpha>\beta$ is established. The nip pad 50 includes a nip press mechanism 53 to press the nip pad 50 toward the heat roller 37 independently of the belt press mechanism 44.

The housing 43 supports the nip pad 50 and the nip press mechanism 53 to enable reciprocating movement in the rotation direction of the press belt 38. The nip pad 50 and the nip press mechanism 53 are slid along the heat roller 37 in the inside of the press belt 38, so that the first distance $\alpha$ and the second distance $\beta$ are changed.

The fixing device 31 starts a warm-up operation by turning on power supply. During the warm-up operation, the CPU 100 controls so that the belt press mechanism 44 presses the housing 43 toward the heat roller 37, the nip press mechanism 53 presses the nip pad 50 toward the heat roller 37, the first to the third halogen lamps 41, 42 and 51 are turned on, and the motor 49 is driven. The heat roller 37 is driven by the rotation of the press belt 38 in the arrow v direction and is rotated in the arrow w direction.

If the warm-up is completed and a ready mode occurs, the CPU 100 controls the first to the third halogen lamps 41, 42 and 51 according to the detection result of the roller thermistor 37*a* or the belt thermistor 38*a*, and keeps the fixing device 31 at a ready temperature. During the ready mode, the CPU 100 controls the nip press mechanism 53, and reduces the pressing force of the nip pad 50 to the heat roller 37 to the pressure in the ready mode. The pressing force of the nip pad 50 is reduced to prevent the heat roller 37 or the nip pad 50 from being deformed.

If the MFP 10 starts printing, the fixing device 31 nips and conveys the sheet P having a toner image from the first position T1 to the second position T2 where the heat roller 37 and the press belt 38 contact each other, and heats, presses and fixes the toner image to the sheet P. The CPU 100 controls the first to the third halogen lamps 41, 42 and 51, and keeps the fixing device 31 at the fixing temperature. During the printing operation, the CPU 100 controls the nip press mechanism 53, and raises the pressure of the nip pad 50 to the heat roller 37 up to the fixing pressure. Since the image on the sheet P is formed of the color erasable toner, the fixing temperature of the fixing device 31 is relatively low. Since the nip width formed between the heat roller 37 and the press belt 38 extends from the first position T1 to the second position T2 and can be set to be large, even if the fixing temperature of the fixing device 31 is set to be low, high fixing performance can be obtained.

If the printing is ended, the CPU 100 controls the nip press mechanism 53 to reduce the pressure of the nip pad 50 to the heat roller 37, and keeps the fixing device 31 at the ready temperature.

Evaluation of the fixing performance of the fixing device 31 will be described.

In the fixing device 31, the first distance α and the second distance β between the first position T1 and the second position T2 of the heat roller 37 and the press belt 38 were changed and shift of an image was evaluated.

Figure 3:
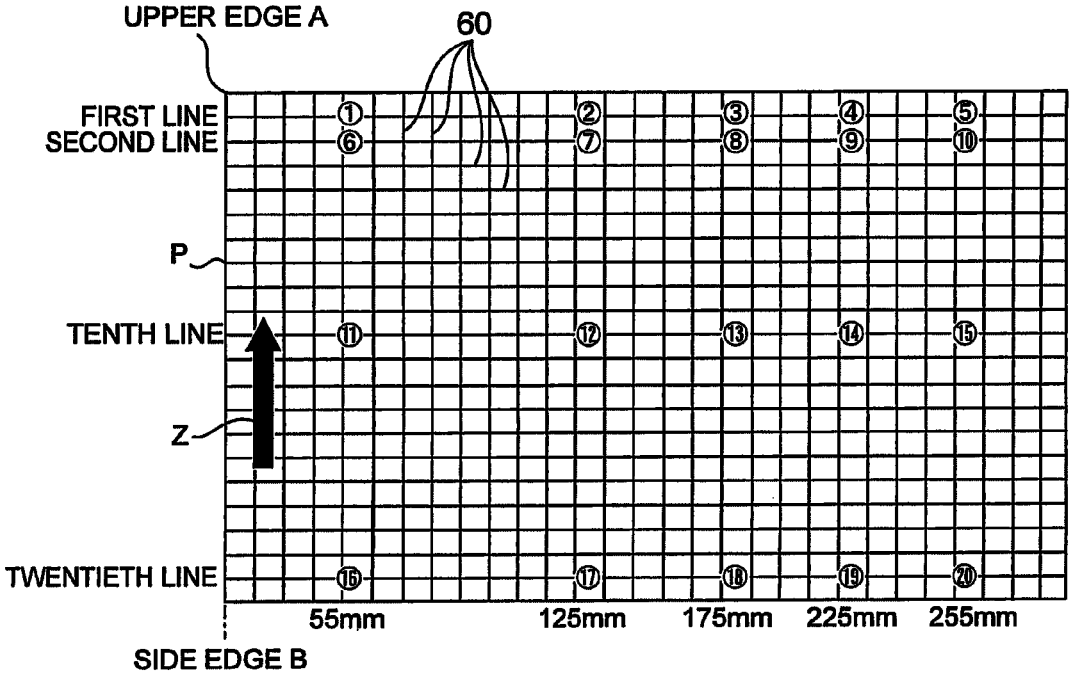
FIG. 3 is an explanatory view showing a lattice image used for evaluation of the image shift caused by the fixing device of the embodiment.

As shown in FIG. 3, the evaluation was made such that a lattice image 60 was printed on a sheet P of A4 size of JIS standard, and shift amounts were measured at four points in an arrow z direction, which is the conveyance direction of the sheet P, and at five points in the direction perpendicular to the conveyance direction of the sheet P, that is, at 4×5=20 points (1) to (20) in total. The four points in the conveyance direction of the sheet P are the first line, the second line, the tenth line and the twentieth line of the lattice image 60 from an upper edge A of the sheet P. The five points in the direction perpendicular to the conveyance direction of the sheet P are 55 mm, 125 mm, 175 mm, 225 mm and 255 mm from a side edge B of the sheet P.

Figure 4:
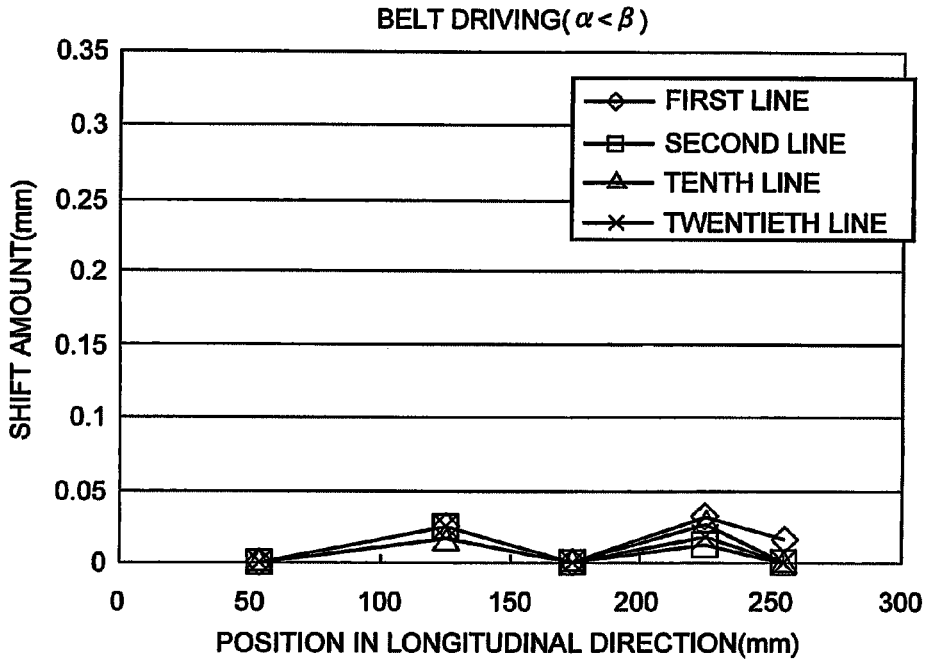
FIG. 4 is a graph showing the result of the image shift if $\alpha>\beta$ is established in the fixing device of the embodiment.

(1) The first distance α and the second distance β between the first position T1 and the second position T2 of the heat roller 37 and the press belt 38 were set to be α>β and the shift evaluation was performed. FIG. 4 shows the result. In the case of α>β, image shift amounts at all the measurement points could be suppressed to 0.05 mm or less, the image shift could not be visually seen, and high fixing performance was obtained.

Figure 5:
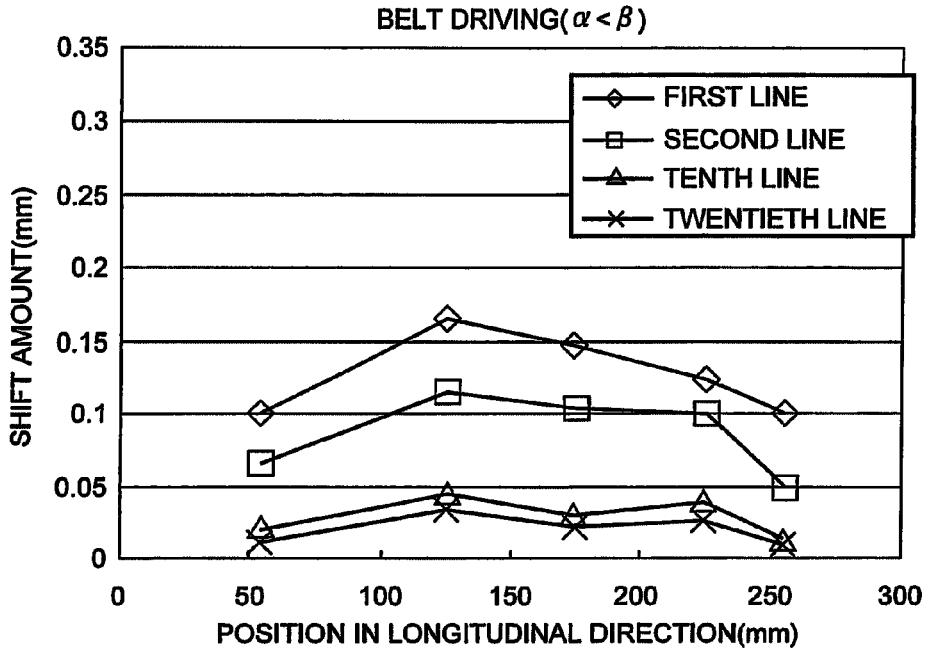
FIG. 5 is a graph showing the result of the image shift if $\alpha<\beta$ is established in the fixing device of the embodiment.

(2) Next, the nip pad 50 and the nip press mechanism 53 were moved in an arrow x direction of FIG. 2 with respect to the housing 43, and the first distance α and the second distance β between the first position T1 and the second position T2 of the heat roller 37 and the press belt 38 were set to be α<β and the shift was evaluated. FIG. 5 shows the result. In the case of α<β, the image shift is large especially at the leading edge of the sheet P. Besides, even at the tenth line or the twentieth line from the leading edge, the image shift is large as compared with the case of α>β.

From the evaluation of the image shift of the above (1) and (2), it was found that in the fixing device 31, if the first distance α and the second distance β between the first position T1 and the second position T2 of the heat roller 37 and the press belt 38 were set to be α>β, the occurrence of the image shift was suppressed.

Figure 6:
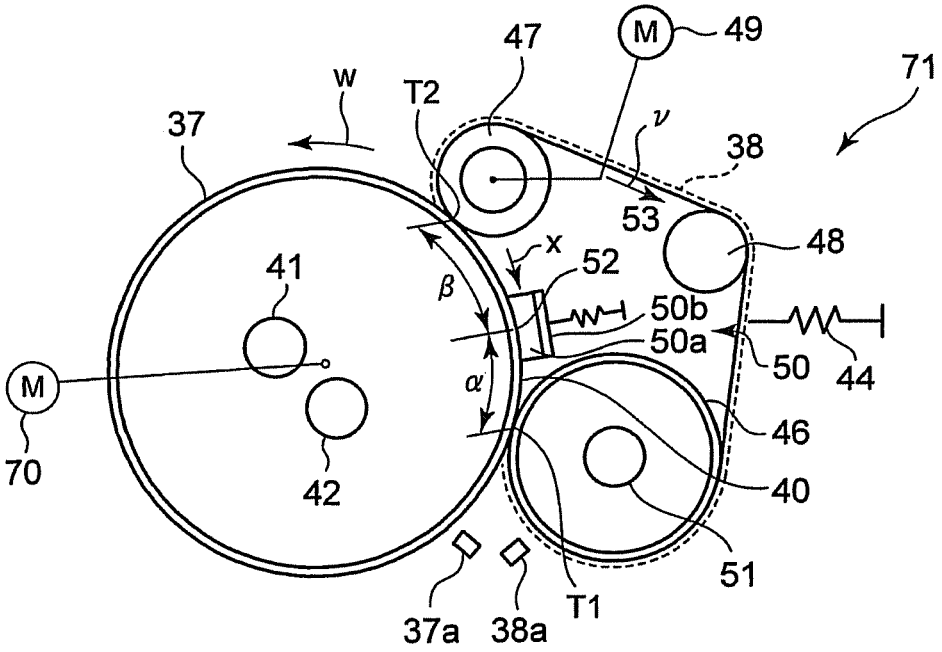
FIG. 6 is a schematic structural view showing a fixing device of a modified example.

Incidentally, instead of driving the press belt 38 by the motor 49 to cause the heat roller 37 to be driven in the fixing device 31, as shown in a modified example of FIG. 6, in a fixing device 71 in which a heat roller 37 is driven by a fixing motor 70 to cause a press belt 38 in press contact with the heat roller 37 to be driven, image shift evaluation similar to the above (1) and (2) was performed.

Figure 7:
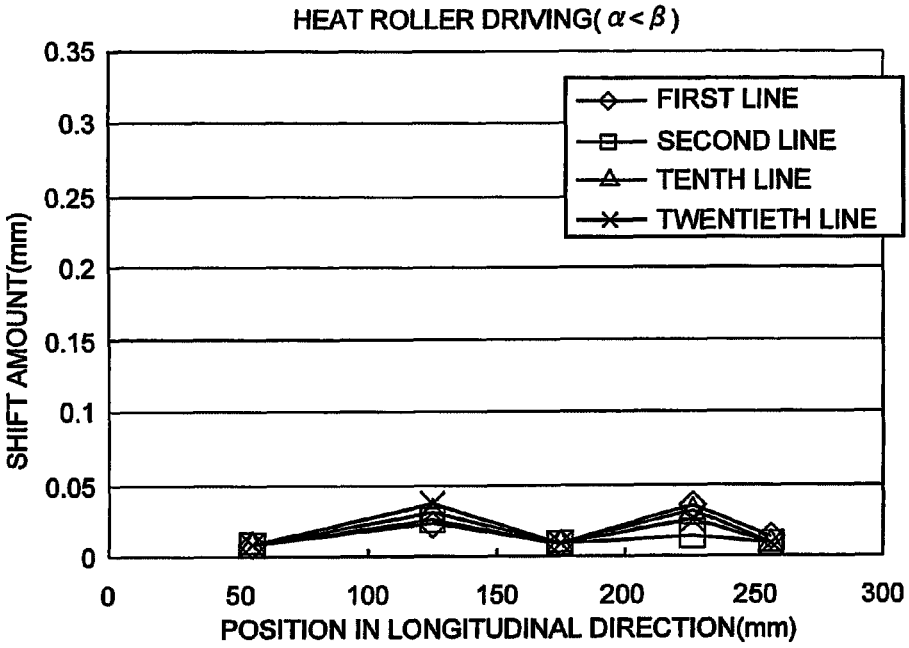
FIG. 7 is a graph showing the result of the image shift if $\alpha>\beta$ is established in the fixing device of the modified example.

(3) FIG. 7 shows the result of the shift evaluation in which the press belt 38 is dependently driven, and the first distance α and the second distance β of the heat roller 37 and the press belt 38 are set to be α>β. In the case of α>β, the image shift amount could be suppressed to 0.05 mm or less at all measurement points, the image shift could not be visually seen, and high fixing performance was obtained.

Figure 8:
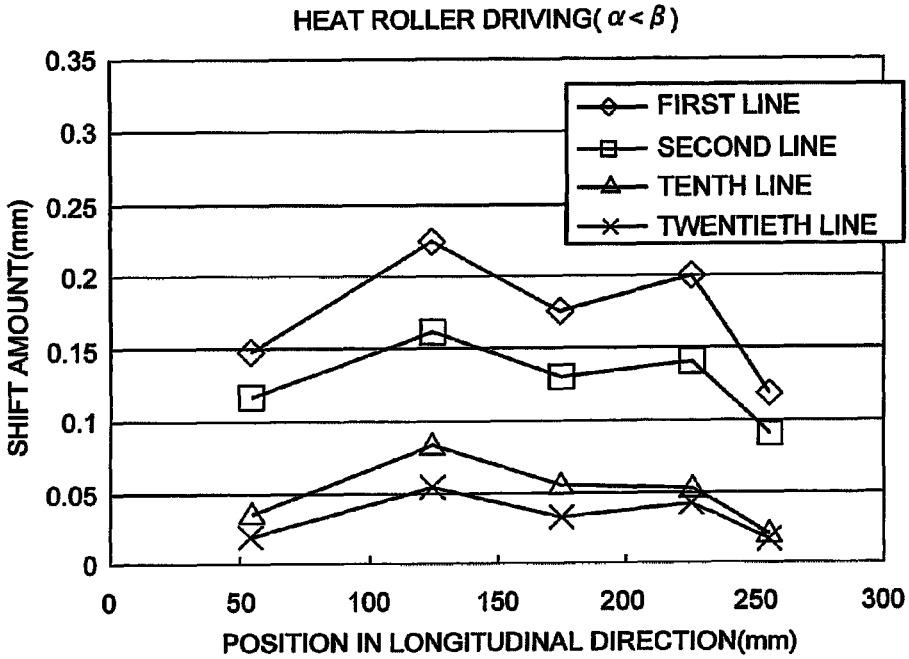
FIG. 8 is a graph showing the result of the image shift if $\alpha<\beta$ is established in the fixing device of the modified example.

(4) Next, FIG. 8 shows the result of the shift evaluation in which the press belt 38 is dependently driven, and the first distance α and the second distance β of the heat roller 37 and the press belt 38 are set to be α<β. In the case of α<β, the image shift is large especially at the leading edge of the sheet P. Besides, even at the tenth line or the twentieth line from the leading edge, the image shift is large as compared with the case of α>β.

From the image shift evaluation of the above (3) and (4), it was found that in the fixing device 71, if the first distance α and the second distance β between the first position T1 and the second position T2 of the heat roller 37 and the press belt 38 were set to be α>β, the occurrence of the image shift was suppressed.

According to the embodiment, the nip pad 50 is provided between the first position T1 and the second position T2 of the press belt 38 of the fixing device 31. In the rotation direction of the press belt 38, the first distance α at the upstream side of the center position 52 of the nip pad 50 and the second distance β at the downstream side of the center position 52 are set to be α>β. Even if the nip width of the fixing device 31 is set to extend from the first position T1 to the second position T2 and is set to be large. The image shift occurring at the time of fixing is suppressed, and high fixing performance is obtained. Since the image shift is suppressed, and the nip width of the fixing device 31 is set to be large, even if an image is formed by color erasable toner having a low fixing temperature, there is no image shift and high fixing performance is obtained.

According to the embodiment and the modified example, in both the fixing device 31 in which the press belt 38 is driven to rotate the heat roller 37 and the fixing device 71 in which the heat roller 37 is driven to rotate the press belt 38, if α>β is set, the image shift occurring at the time of fixing is suppressed, and high fixing performance is obtained.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A fixing device comprising:

a fixing roller including a heat generating part;

an endless belt facing the fixing roller;

a first supporter which supports the belt to cause the belt to face the fixing roller at a first position;

a second supporter which supports the belt at a downstream side in the rotation direction of the belt to cause the belt to face the fixing roller at a second position; and a pressure applying member, having a center position, configured to urge the belt toward the fixing roller to form a nip between the fixing roller and the belt, wherein a first distance between the center position and the first position is longer than a second distance between the center position and the second position.

2. The device of claim 1, further comprising a belt driving part to rotate the belt, wherein the fixing roller is driven and rotated by the belt.

3. The device of claim 1, further comprising a fixing driving part to rotate the fixing roller, wherein the belt is driven and rotated by the fixing roller.

4. The device of claim 1, further comprising a second heat generating part to heat the belt.

5. The device of claim 1, wherein the fixing roller and the belt nip and convey a recording medium with a color erasable image made of a color erasable colorant at the nip.

6. The device of claim 1, wherein the pressure applying member can be reciprocated in the rotation direction of the belt between the first supporter and the second supporter.

7. The device of claim 1, wherein the pressure applying member is symmetrical with respect to the center position in the rotation direction of the belt.

8. The device of claim 1, wherein the first supporter is a first roller, and the second supporter is a second roller having a diameter smaller than the first roller.

9. An image forming apparatus comprising:

an image forming part to form an image on a recording medium;

a fixing roller which includes a heat generating part, contacts the recording medium, and fixes the image to the recording medium;

an endless belt facing the fixing roller;

a first supporter which supports the belt to cause the belt to face the fixing roller at a first position;

a second supporter which supports the belt at a downstream side in the rotation direction of the belt to cause the belt to face the fixing roller at a second position; and a pressure applying member having a center position, configured to urge the belt toward the fixing roller to form a nip between the fixing roller and the belt, wherein a first distance between the center position and the first position is longer than a second distance between the center position and the second position.

10. The apparatus of claim 9, further comprising a belt driving part to rotate the belt, wherein the fixing roller is driven and rotated by the belt.

11. The apparatus of claim 9, further comprising a fixing driving part to rotate the fixing roller, wherein the belt is driven and rotated by the fixing roller.

12. The apparatus of claim 9, further comprising a second heat generating part to heat the belt.

13. The apparatus of claim 9, wherein the fixing roller and the belt nip and convey a recording medium with a color erasable image made of a color erasable colorant at the nip.

14. The apparatus of claim 9, wherein the pressure applying member can be reciprocated in the rotation direction of the belt between the first supporter and the second supporter.

15. The apparatus of claim 9, wherein the pressure applying member is symmetrical with respect to the center position in the rotation direction of the belt.

16. The apparatus of claim 9, wherein the first supporter is a first roller, and the second supporter is a second roller having a diameter smaller than the first roller.

* * * * *